US012698614B2

(12) United States Patent
Halischuk

(10) Patent No.: US 12,698,614 B2
(45) Date of Patent: Aug. 4, 2026

(54) DRAG BAR FOR LEVELLING GROUND

(71) Applicant: Corrie Halischuk, Clandeboye (CA)

(72) Inventor: Corrie Halischuk, Clandeboye (CA)

( * ) Notice: Subject to any disclaimer, the term of this patent is extended or adjusted under 35 U.S.C. 154(b) by 745 days.

(21) Appl. No.: 17/980,144

(22) Filed: Nov. 3, 2022

(65) Prior Publication Data

US 2023/0125391 A1 Apr. 27, 2023

Related U.S. Application Data

(63) Continuation-in-part of application No. 17/842,081, filed on Jun. 16, 2022, now abandoned.

(60) Provisional application No. 63/223,363, filed on Jul. 19, 2021.

(51) Int. Cl.
*E02F 3/76* (2006.01)
*E02F 3/815* (2006.01)

(52) U.S. Cl.
CPC ..... *E02F 3/7622* (2013.01); *E02F 3/8152* (2013.01)

(58) Field of Classification Search
CPC ..... A01B 31/00; A01B 33/02; A01B 33/021
USPC ..... 172/21, 34
See application file for complete search history.

(56) References Cited

U.S. PATENT DOCUMENTS

| | | | | |
|---|---|---|---|---|
| 4,386,662 | A * | 6/1983 | Kalif | A01B 31/00 172/780 |
| 7,063,166 | B1 * | 6/2006 | Grosberg | A01B 31/00 172/620 |
| 7,096,971 | B1 * | 8/2006 | Gendron | A01B 31/00 172/684.5 |
| 7,273,111 | B2 * | 9/2007 | Johnson | E02F 3/815 37/231 |
| 2002/0144828 | A1 * | 10/2002 | Keigley | A01B 31/00 172/197 |
| 2007/0012464 | A1 * | 1/2007 | Juergen | A01B 31/00 172/145 |

* cited by examiner

*Primary Examiner* — Christopher J Sebesta
*Assistant Examiner* — Evan A Bregel
(74) *Attorney, Agent, or Firm* — Adrian D. Battison; Ryan W. Dupuis; Ade & Company Inc.

(57) ABSTRACT

A drag bar for attachment to forks of a tractor for ground levelling includes a frame with two parallel fork ports and two transverse members one of which is a plate having ground scraping elements for breaking the surface of the ground and the other has a leveling surface for compressing and levelling the ground surface. The plate carries front and rear alternately offset rows of the elements and has front and rear edges shaped in a wave pattern. The transverse member further carries a pivotal drag plate with a bottom edge at a height above a lowermost tip of the ground scraping elements. Each of the fork ports includes an upper receptacle for receiving a fork of a tractor and a lower upwardly inclined receptacle for receiving a fork of a skid steer loader. The frame can be divided into separate sections for grading traffic wheel strips of a gravel road.

15 Claims, 11 Drawing Sheets

DRAG BAR FOR LEVELLING GROUND

This application is a continuation in part application of application Ser. No. 17/842,081 filed Jun. 16, 2022.

This application claims the benefit under 35 USC 119 (e) of Provisional application 63/223,363 filed Jul. 19, 2021.

This invention relates to a drag bar arranged for mounting on forks of a tractor which can be carried over rough ground for use in levelling the ground.

BACKGROUND OF THE INVENTION

Drag bars for use on skid steer loaders used for levelling ground are known and many examples are available.

The arrangement herein provides a number of improved features.

SUMMARY OF THE INVENTION

According to the invention there is provided a drag bar apparatus for attachment to a tractor allowing levelling of ground over which the tractor passes, the tractor having forwardly projecting forks for engaging the drag bar apparatus, the apparatus comprising:

a frame having a generally planar body for resting on the ground;

wherein the frame includes two fork ports arranged side by side parallel to the forward direction so that the frame can be lifted and moved by the forks of the tractor in a levelling action;

the frame including a front member transverse member and a rear transverse member forming two parallel components for engaging the ground sequentially as the frame is moved forwardly and rearwardly over the ground;

one of the transverse members comprising a plate having downward projecting ground scraping elements for breaking the surface of the ground;

the other of the transverse members having a leveling surface for compressing and levelling the ground surface.

In one preferred arrangement the scraping elements comprise individual teeth such as carbide pins which extend through the plate to provide a pointed lower end for engaging the ground. The carbide teeth have the advantaged that they can be individually hardened and replaced when worn. However other arrangements of scraping elements can be used.

In one preferred arrangement the plate carries front and rear rows of ground scraping elements with the ground scraping elements of the front row alternately offset from the ground scraping elements of the rear row. This can preferably be achieved where the plate has front and rear edges each of which is shaped in a plane of the plate to define a wave pattern. In this way with the teeth arranged at the apexes of the wave pattern and with the wave patterns out of phase.

In one preferred arrangement the transverse member with the teeth carries a drag plate therealong with a lower edge of the drag plate at a height above a lowermost tip of the projecting teeth. The drag bar thus is carried with the plate and teeth and cooperates with them in operation on the ground in guiding the material that breaks away from the ground in a grading action. For this purpose the drag plate is preferably pivotal about an axis along the transverse member so as to be pivotal from a first position inclined forwardly and downwardly as the frame is pulled rearwardly to a second position inclined rearwardly and downwardly as the frame moves forwardly. In the first position the drag plate preferably engages a rear edge of the plate which acts to cooperate with the spaces defined by the wave form shape so that material can pass between the plate and the drag bar. Preferably a height of the drag plate adjustable.

In one preferred arrangement each of the fork ports includes an upper receptacle for receiving a fork of a larger tractor and a lower receptacle for receiving a fork of a skid steer loader. Because skid steer loaders have the forks lower and inclined upwardly, preferably the lower receptacle is inclined upwardly and forwardly relative to the upper receptacle. To provide the required heights of operation, preferably the lower receptacle passes through the transverse members and the upper receptacle is located on top of the transverse members.

In one important operation of the leveller apparatus, the frame is used to operate on gravel roads and particularly to groom the tire track sections of a gravel road. For this reason preferably the frame is divided into a plurality of sections arranged in a row across the transverse members where at least one of the sections is free from the ground scraping elements and the levelling surface.

In this arrangement, preferably the free section includes a ground engaging grader bar inclined to a line along the transverse member to draw material from the free section into the section or sections operating with the teeth on the wheel tracks.

In one arrangement, the free section is a middle section with two wing sections one on each side for the middle section to be used to grade a single traffic wheel strip of the gravel road with the wing sections arranged to pull material into the middle section.

In another arrangement, the free section is located between two wing section with a the two wing sections to be used to grade a the two traffic wheel strips of the gravel road with the middle section arranged to pull material into at least one of the two wing sections.

Also described herein is a drag bar apparatus for attachment to a tractor allowing levelling of soil over which the tractor passes, the tractor having at least one forwardly projecting fork for engaging the drag bar apparatus, the apparatus comprising:

- a frame having a generally planar body for resting on the soil;
- a mounting member for mounting on the fork;
- a support head for attachment to the mounting member so as to attach the frame to the mounting member for movement of the frame with the tractor while the planar body slides over the soil;
- wherein the frame includes a first surface on a first face which is defined by flat bars for sliding smoothly over the soil and a second surface on a second face which includes teeth for biting into the soil;
- and wherein the frame is attached in a manner which allows a selected one of the first and second faces to rest against the soil while the other of the first and second faces is away from the soil.

Preferably the first and second faces are parallel and opposed faces as this allows the structure to be planar and flipped over to provide the different orientations. That is the frame is inverted to place the selected one of the faces in contact with the soil so that the frame flips over.

Preferably the frame has a front bar and a rear bar and flips over by rotation about a transverse axis so that when moving in one orientation the front bar is forward and when moving in the other orientation the front bar is rearward allowing the frame to be pushed in one orientation and pulled in the other orientation.

Preferably the second surface which is arranged for more aggressive action on the soil includes transversely extending plates with teeth downwardly extending from the plates into engagement with the soil.

Preferably the second surface which is arranged for more aggressive action on the soil includes additional depending fingers, preferably located between front and rear plates. The fingers may pivot from an engagement position, in which the teeth are preferably rearwardly inclined relative to a forward movement direction, to a retracted position.

Preferably the frame is attached to the support head by at least one flex cable and preferably two side by side flex cables which bend though 180 degrees as the frame flips over. This provides a simple flipping action while the cables allow the movement to the two positions while holding the structure in a stable position.

Preferably the mounting member includes a cross bar and support head can slide side to side across the cross bar. This side to side movement changes an angle of a forward axis of the frame to a forward direction so as to incline the frame to the forward direction to tend to move the soil to one side or the other of the frame. Thus the operator can change the direction of soil movement simply by sliding the head to one side of the other.

Preferably there are provided safety chains or straps between the frame and the support head to maintain the frame against unintentional movement when flipping over or when fixed in one orientation for storage. The straps or chains adjust to different hold positions.

Preferably there is provided a pressure pad connected to mounting member for pressing down on the frame when folded underneath to press the teeth of the second face into the ground in a cutting action. In this way the amount of aggression can be simply controlled by the operator by changing the angle of the forks to apply more or less pressure.

Preferably the frame includes two fork ports arranged side by side parallel to the forward direction so that the frame can be lifted and moved by the forks of the tractor in a levelling action when the tractor is disconnected from the mounting member, the fork ports preferably being accessed from a forward end of the frame opposite the support head. In this way the frame can be used in an alternative operation where the mounting is not used and is held in fixed position by the safety straps Preferably there is provided a gauge plate separate from the frame with a mounting arrangement for mounting of the gauge plate on the forks at a position on the forks closer to the tractor so that both the gauge plate and the frame run over the ground in a levelling action as the tractor moves forwardly. This is used with the additional fork ports on the frame so that the operation is carried out by mounting the frame and the gauge plate together but separately on the forks with the gauge plate running on the ground and guiding the height of the surfaces of the frame as they work the soil.

Preferably the gauge plate is vertically adjustable relative to the attachment member and the frame.

In one optional feature the gauge plate includes a mechanism for causing vibration of the gauge plate as it moves across the ground with the frame. This can assist with smoothing the soil as the plate and frame run over the soil in the levelling action.

Also described herein is a drag bar apparatus for attachment to a tractor allowing levelling of soil over which the tractor passes, the tractor having at least one forwardly projecting fork for engaging the drag bar apparatus, the apparatus comprising:

- a frame having a generally planar body for resting on the soil;
- a mounting member for mounting on the fork;
- a support head for attachment to the mounting member so as to attach the frame to the mounting member for movement of the frame with the tractor while the planar body slides over the soil;
- wherein the mounting member includes a cross bar and support head can slide side to side across the cross bar;
- and wherein the side to side movement changes an angle of a forward axis of the frame to a forward direction so as to incline the frame to the forward direction to tend to move the soil to one side or the other of the frame.

Also described herein is a drag bar apparatus for attachment to a tractor allowing levelling of soil over which the tractor passes, the tractor having at least one forwardly projecting fork for engaging the drag bar apparatus, the apparatus comprising:

- a frame having a generally planar body for resting on the soil;
- a mounting member for mounting on the fork;
- a support head for attachment to the mounting member so as to attach the frame to the mounting member for movement of the frame with the tractor while the planar body slides over the soil;
- wherein the frame is attached to the support head by at least one flex cable which allows pivotal movement of the frame relative to the support head.

Also described herein is a drag bar apparatus for attachment to a tractor allowing levelling of soil over which the tractor passes, the tractor having at least one forwardly projecting fork for engaging the drag bar apparatus, the apparatus comprising:

- a frame having a generally planar body for resting on the soil;
- wherein the frame includes two fork ports arranged side by side parallel to the forward direction so that the frame can be lifted and moved by the forks of the tractor in a levelling action;
- and wherein there is provided a gauge plate separate from the frame with a mounting arrangement for mounting of the gauge plate on the forks at a position on the forks closer to the tractor so that both the gauge plate and the frame run over the ground in a levelling action as the tractor moves forwardly.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
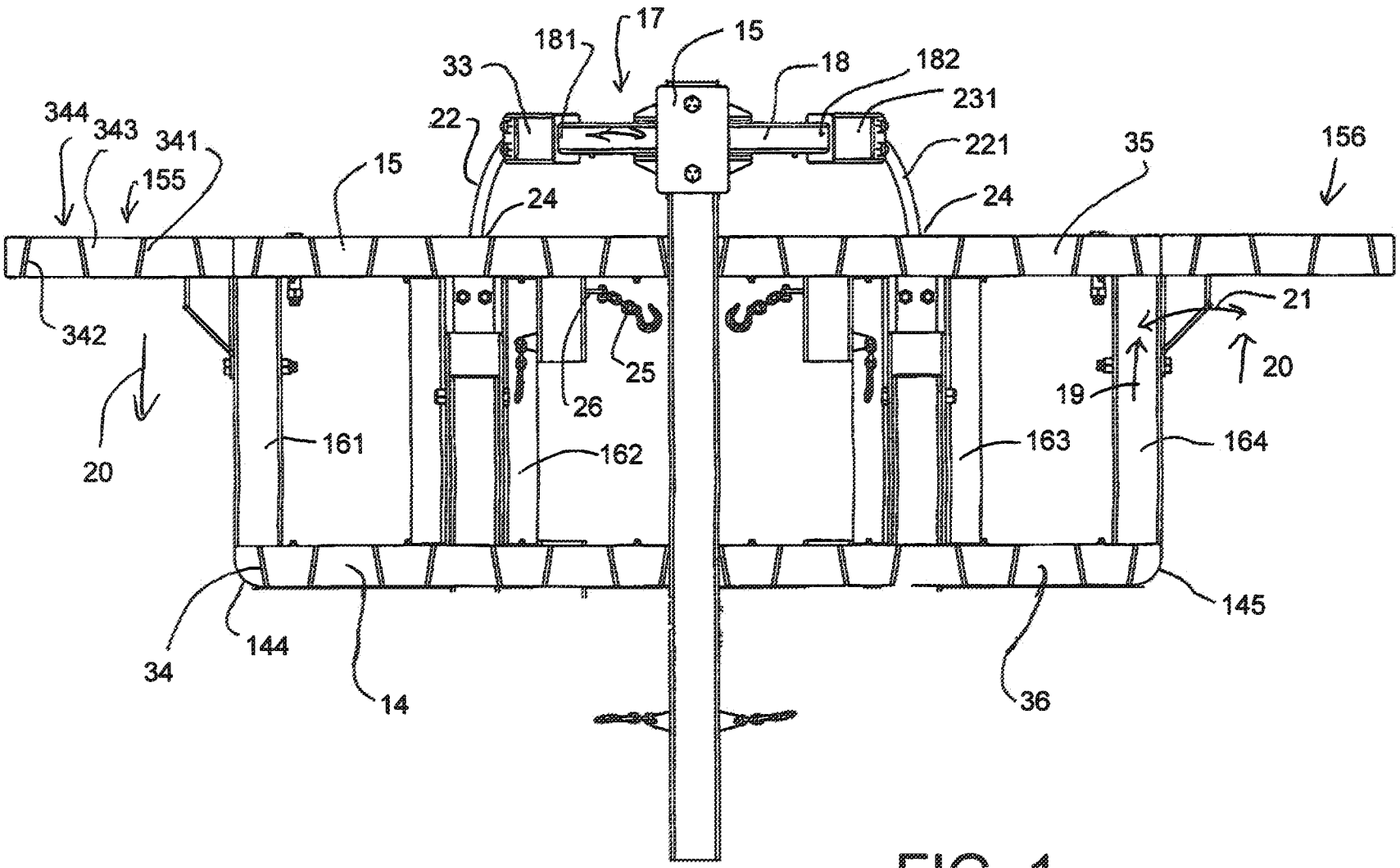
FIG. 1 is a plan view of a drag bar apparatus according to the present invention.
Figure 2:
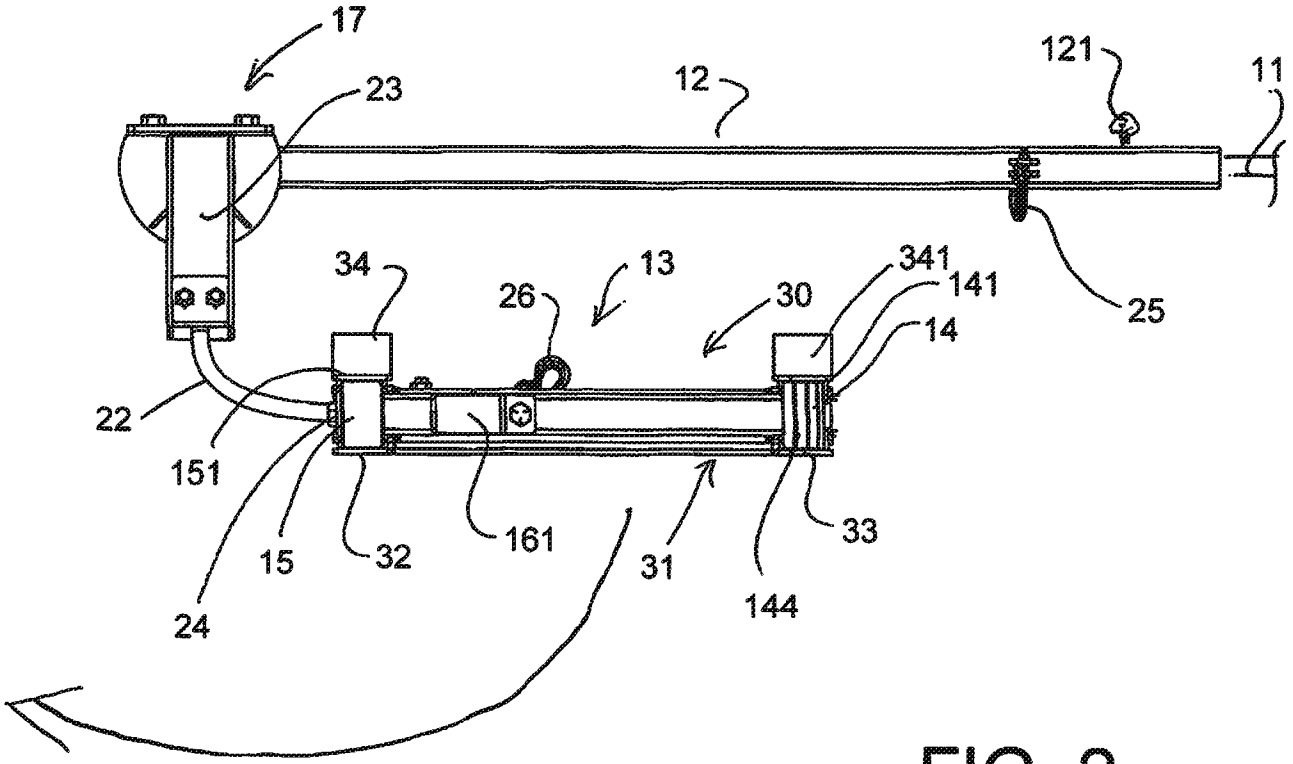
FIG. 2 is a side elevational view of the drag bar apparatus of Figure
Figure 3:
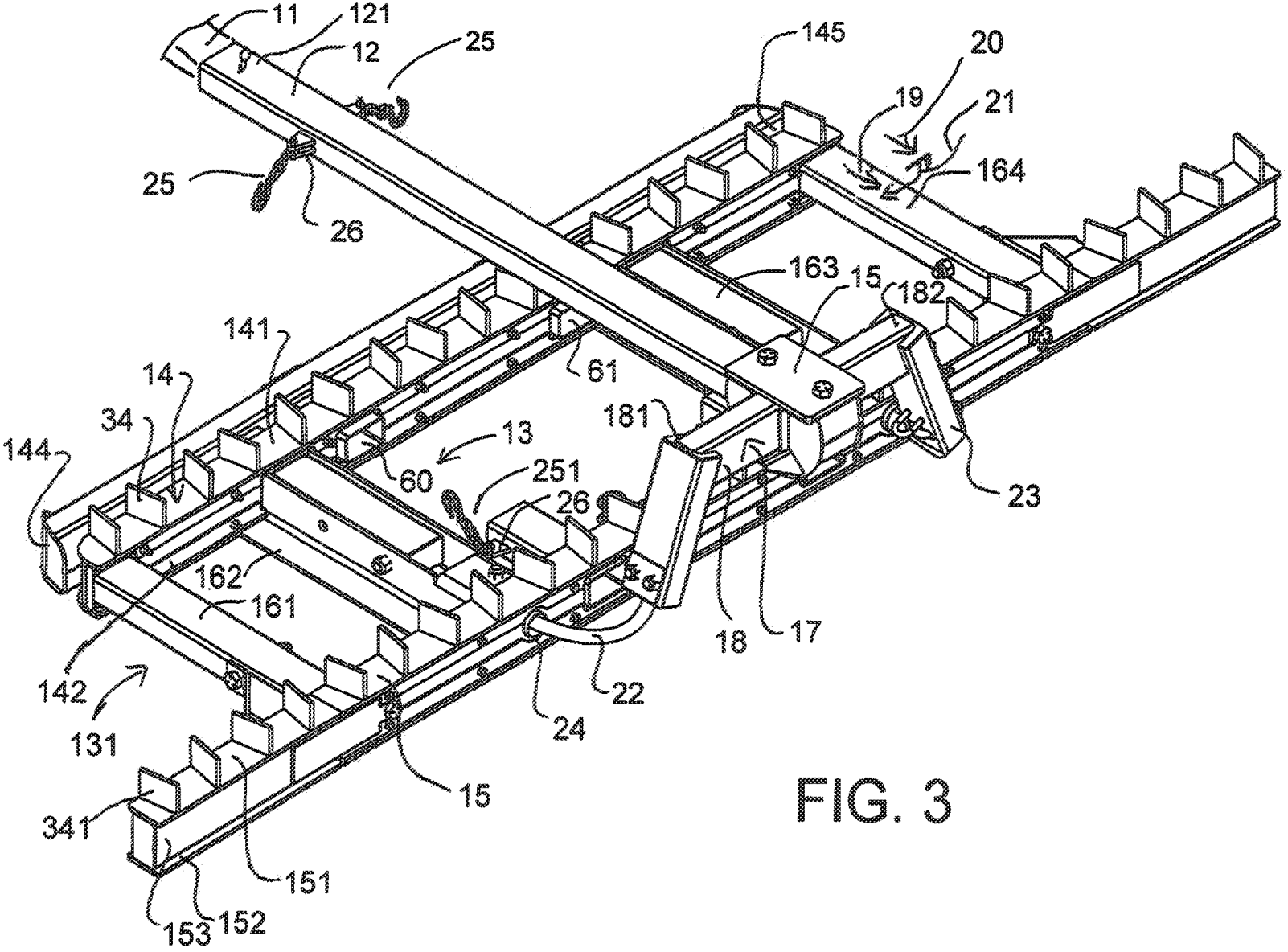
FIG. 3 is an isometric view from the rear and one side of the drag bar apparatus of FIG. 1 including a second arrangement having a levelling bar attachment.
Figure 4:
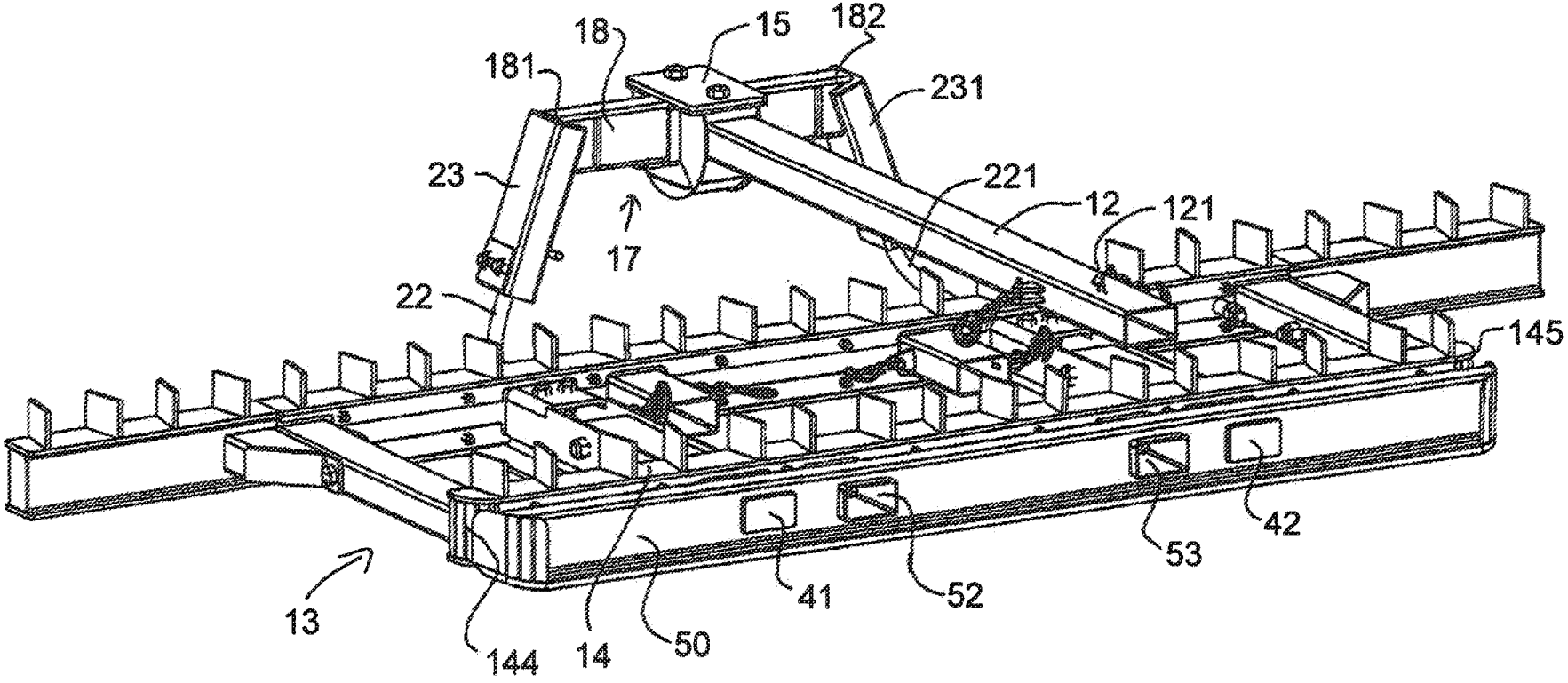
FIGS. 4, 5 and 6 are isometric views of the drag bar apparatus of FIG. 3 including a second arrangement having a levelling bar attachment.
Figure 5:
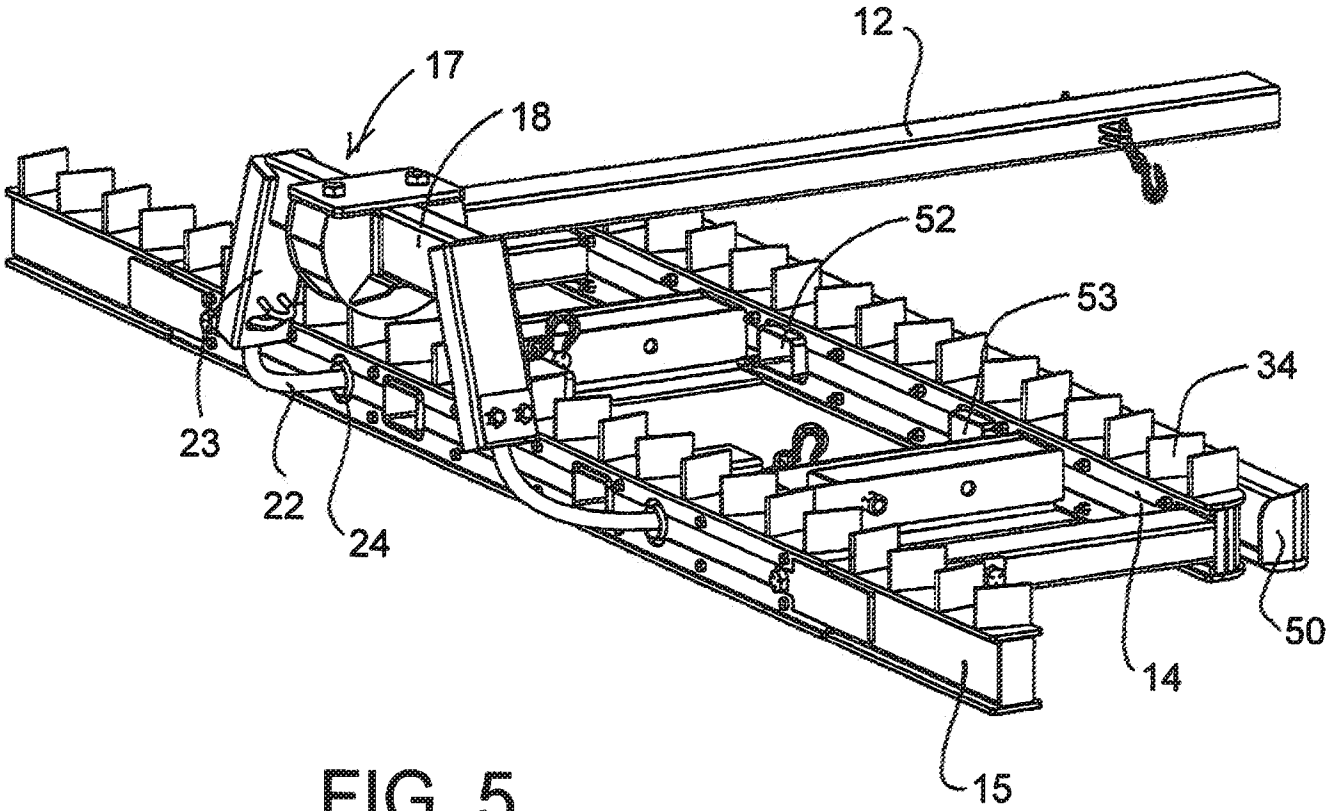

A drag bar apparatus 10 for attachment to a tractor (not shown) is used for allowing levelling of soil over which the tractor passes.

The tractor is typically of the skid steer type with two forks projecting forwardly for attachment to various implements. In this arrangement only one of the forks is used with the attachment system described.

In addition the same mounting system as described herein can be used with for example the bucket of a front end loader.

Thus the tractor provides at least one forwardly projecting fork 11 for engaging the drag bar apparatus.

The fork 11 projects into a sleeve 12 and is attached to the sleeve 12 by a pin 121 and/or chains (not shown).

The apparatus 10 includes a rectangular planar frame 13 having a generally planar body 131 for resting on the soil. The frame has a front bar 14 and a rear bar 15 connected by forwardly extending beams 161, 162, 163 and 164 to form a rigid rectangular structure where the ends of the beams are welded to the front and rear bars. The beams are formed by metal tubes. The front and rear bars form channel members with a top plate 141, 151 and a bottom plate 142, 152. The top and bottom plates are connected by an outer wall 143, 153.

The apparatus further includes a mounting member 17 attached to the frame 13 and connecting the frame to the sleeve 12 for mounting on the fork 11.

The apparatus further includes a support head 15 for attachment to the sleeve 12 so as to attach the frame 13 to the mounting member 12 for forward and rearward movement of the frame 13 with the tractor while the planar body 131 slides over the soil in the levelling action.

The mounting member 17 includes a cross bar 18 and the support head 15 can slide side to side across the cross bar 18 from one end 181 to the other end 182 of the cross bar. This changes the position of the fork 11 side to side relative to the frame 13 so as to change the angle 21 of a forward axis 19 of the frame along the beams 161 relative to a forward direction 20. This change in angle 21 acts so as to incline the frame and particularly beams 161 relative to the forward direction so that the front and rear bars 14, 15 are inclined to a line at a right angle to the forward direction. This incline of the bars acts to move the soil to one side of the frame as the soil is pushed by the frame. The front corners 144, 145 at the bar 14 of the frame 13 are smoothly curved around an axis at tight angles to the ground to push soil away from those corners as the bar is moved forwardly across the ground.

The frame 13 is attached to the support head 17 by at two forwardly extending flex cables 221 and 22 which are connected by mounting sleeves 23 and 231 at the rear end to the cross bar 18 of the mounting 17 and extend therefrom to a coupling 24 on the rear bar 15 of the frame 13. The flex cables 22 and 221 can bend and flex to allow the frame to take up different positions relative to the cross bar 18 attached by the head 15 and the sleeve 12 to the fork 11.

The apparatus further includes safety chains or straps 25 and 251 between the frame 13 and the mounting 17 and/or the sleeve 12 to maintain the frame against unintentional movement in operation or in storage, bearing in mind that the cables 22, 221 allow the flexing movement and thus do not effectively control the movement. The straps 25 can be moved to different positions by selecting different coupling loops 26 on the frame.

The frame 13 is designed to operate in two different orientations to provide two different effects on the soil over which the frame passes in the drag bar effect. Thus the frame 13 includes a first surface 31 on a first face which is defined by flat bar surfaces 32 and 33 on the bottom 142, 152 of the bars 14, 15 for sliding smoothly over the soil. The frame further includes a second surface 30 on a second face which includes teeth 34, 341 for biting into the soil. The teeth 34, 341 are provided on the top wall 141, 151 of the bars 14, 15.

The frame is attached in a manner which allows a selected one of the first and second faces 30, 31 to rest against the soil while the other of the first and second faces is away from the soil so as top face upwardly away from the soil. Thus the first and second faces are parallel and opposed faces and the frame is inverted to place the selected one of the faces in contact with the soil so that the frame flips over. The frame has a front bar 14 and a rear bar 15 and flips over by rotation about a transverse axis at or adjacent the bar 15 and defined by the flex wires 22, 221 so that when moving in one orientation the front bar 15 is forward and when moving in the other orientation the front bar 15 is rearward allowing the frame to be pushed in one orientation and pulled in the other orientation. This flip over happens automatically on changing direction and is allowed by the flex in the cables 21, 221 which can flex through roughly 180 degrees to achieve this movement with the two cables holding the frame stable and a set angle to the forward direction in both positions.

The second surface 30 includes transversely extending plates 35, 36 with teeth 34, 341 extending downwardly from and at right angles to the plates into engagement with the soil. The teeth 34, 341 are formed by flat plates arranged in pairs 344 defined by two plates which are diverging at a shallow angle to the forward direction 20 so as to push the soil toward the left and right as the teeth move forwardly along direction 20.

The second surface 30 may include additional depending fingers or teeth (not shown) located between front and rear plates 35, 36 of the bars 14, 15 where the fingers can pivot from an engagement position when required for additional soil working action to a retracted position removed from the soil. In the engagement position the teeth or fingers project rearwardly and downwardly relative to a forward movement direction to engage the soil as part of the working action defined by the toothed side 30. The additional teeth thus provide a further more aggressive action if required.

In the higher aggression position there can be provided a pressure pad (not shown) connected on the underside of the sleeve 12 for pressing down on the frame 13 when folded underneath to press the teeth of the second face into the ground in a cutting action.

It will be appreciated that the frame 13 can be mounted either in the orientation shown where the teeth side 30 is upward when the frame underlies the sleeve 12 or can be inverted so that the teeth side 30 is downward. This can be achieved by selecting the orientation of the wires 22, 221 relative to the mounting 24. The front bar 15 is longer than the rear bar 14 so that it includes wing portions 155, 156 extending outwardly to each side beyond the outermost beam 161, 164.

Figure 7:
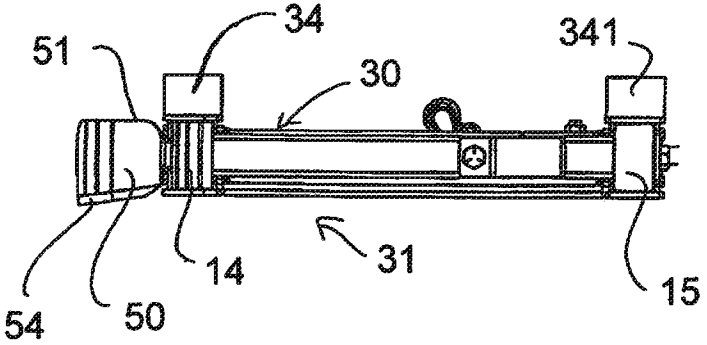
FIG. 7 is a side elevational view of the apparatus of FIG. 3.

In addition to the two modes of push and pull described above, a further mode of operation can be carried out where the mounting system is disabled or strapped into a storage position or even removed as shown in FIG. 7. In addition, the further mode can be used with a drag bar apparatus which does not include the mounting system described above or the reversing mode operation.

Figure 6:
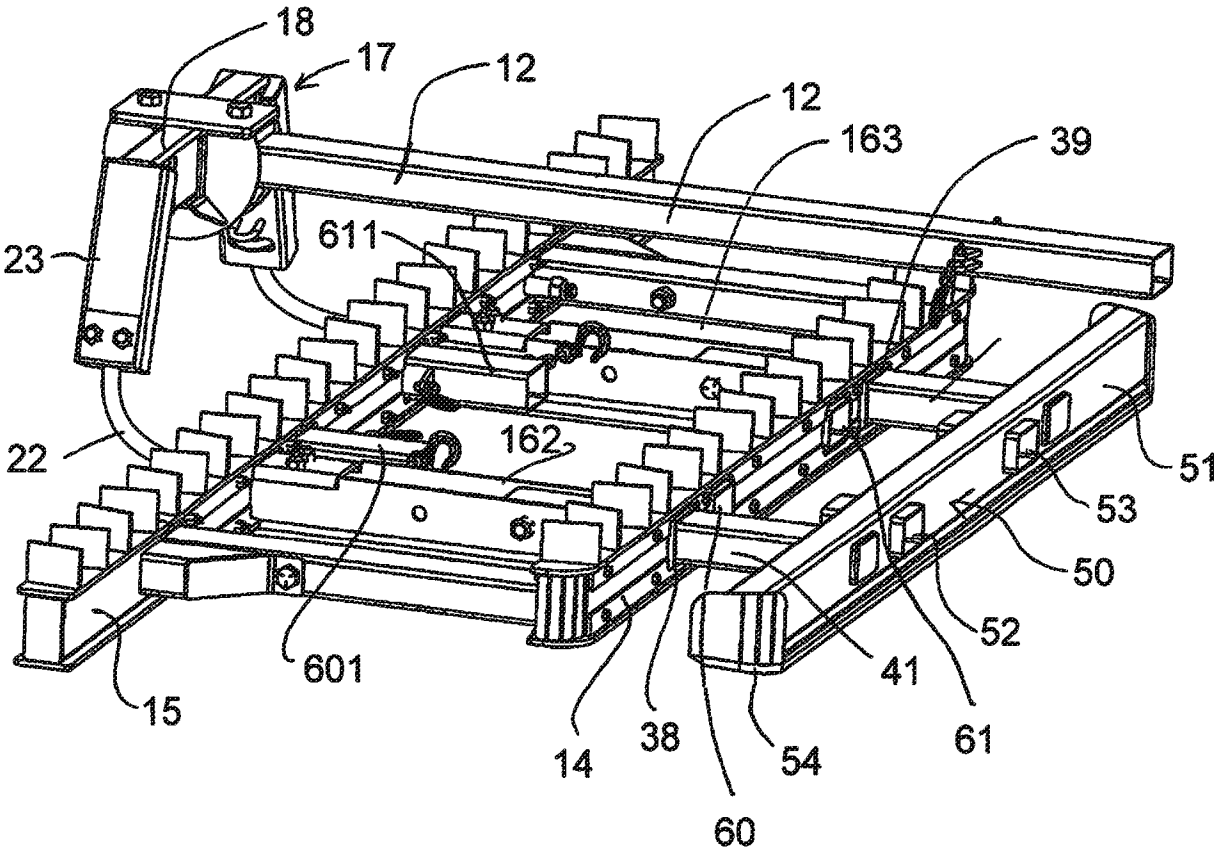

In this further mode a rectangular frame shown in FIG. 6 is either provided by the frame 13 as shown or a dedicated separate frame without the mounting system. This frame includes two fork ports 60 and 61 arranged side by side parallel to the forward direction to receive the forks of a tractor. The ports 60, 61 include an opening in the bar 14 and a second tube 601 and 611 in the bar 15 so that the forks from the tractor can slide into the tubes through the ports 60, 61 to support the frame on the forks provided by a tractor. In this way the height, position and orientation relative to the ground can be controlled by the conventional movement of the forks. Thus the frame can be lifted and moved by the forks of the tractor in a levelling action when the tractor is disconnected from the mounting member. As shown the fork ports 60, 61 are in the forward bar 14 so that the fork ports are accessed from a forward end of the frame opposite the support head 17 and the wires 22.

Also for optional use in this mode there is provided a gauge plate apparatus 50 shown in FIGS. 6 and 7 for use with the frame. The gauge plate apparatus 50 is separate from the frame 13 and includes two forks 41, 42 in front of the frame which slide into receptacles 38 and 39 in the bar 14 to connect the apparatus 50 and the frame 13. The apparatus 50 includes a mounting tube 51 with fork ports 52, 53 for receiving the two forks of the tractor at a position on the forks closer to the tractor with the forks extending through the ports 52, 53 into the ports 60, 61 so that both the gauge plate apparatus 50 and the frame 13 are carried on the tractor forks and run over the ground in a levelling action as the tractor moves forwardly. On the bottom of the tube 51 is mounted a plate 54 with a flat bottom face to rest on the ground. The plate has a forward edge 56 underneath the plate 33 of the frame 13. The plate may have an upturned rear edge to allow it better to run over the ground without biting. The plate has a width and length sufficient to run over the soil and act as a gauge by floating on the surface without tendency to dig into the ground and in this way the plate acts a gauge to locate a required height of the frame 13 which has a greater tendency to dig or bite into the soil in a working action so that its depth is more difficult to control.

The gauge plate 54 may be vertically adjustable relative to the attachment tube 51 and thus relative to the frame 13 which is located at the same height as the tube 51 by the forks.

The combination of the guide plate which floats and the frame which works the soil provides a drag system where the depth of operation can be readily controlled. The operator can locate the drag frame at a required working depth by tilting the forks so that the gauge plate is at a height slightly above or below the frame so that the frame can engage raised ridges or depressions and carry worked soil to a required location and required depth. Thus the floating action of the gauge plate can be used to tilt the frame upwardly or downwardly as required relative to the gauge plate as required using the simple controls of the tractor forks.

The gauge plate may include a mechanism for causing vibration of the gauge plate as it moves across the ground with the frame.

The arrangement described above thus provides the following features:

-a- The flex cable head mounting system 15, 17, 22 anchors to the main frame while allowing the flipping action of main frame from the tooth cutting edge to the smooth straight cutting edge.

-b- The length and spacing of the two flex cables 22 are designed to retard the swing of main frame and thus control its movements as it flips over or inverts between the two modes.

-c- The length and spacing of the two flex cables 22 are also designed to allow torque to transfer downward force from the fork boom to the main frame cutting edge.

-d- The orientation of the main frame 13 and the teeth thereon allows the operator the select the choice to PUSH the tooth bar cutting edge and PULL the straight edge.

-e- The fork boom 12 can be hooked-up to the cable head system 15 on either side. Therefore, by repositioning the fork boom to the opposite side of the cable head system 15 will now allow operator to select a situation to PUSH the straight edge and PULL the tooth bar cutting edge.

-f- The fork boom 12 slide onto one loader fork blade 11, but it can be solidly attached to the tractor (skid steer loader) by welding on a quick-attach to the fork boom 12. No chain would then be required.

As described above, the boom head 17 can travel along the cable head system or support bar 18 to off-set to one side the push-pull drag bar frame 13, thereby changing the angle of the bars 14 and 15 to the loader. This tends to drive material distribution from right-to-left, or vice-versa. It also allows an extended reach under trees, objects, etc. to the right or to the left of the loader.

The system is operated as follows:

-a- Firstly, the cable head system is chained in an upright position according to chosen cutting edge.

-b-Then the fork boom is removed from the cable head system.

-c- If so desired, the skid plate 50 is inserted to main frame. This skid plate 50 provides a reference point to the ground for operator to gauge the heel of the back edge action of main frame 13. The bottom plate 54 of the skid plate system also offers a slight compaction.

-d- The loader forks are inserted through the ports of the skid plate system 50 and main frame ports of the frame 13, so that this combination now becomes the soil planer.

-e- This combined soil planer is locked to the loader by chaining the main frame 13 to the loader fork carriage. This also allows backward motion to drag the planer rearwardly.

As an option (not shown) two rows of shovels can be used with the tooth cutting edge to summer fall weeds.

Turning now to FIGS. 8 to 11 there is shown a further embodiment of a drag bar apparatus 70 for attachment to a tractor for carrying out levelling of ground over which the tractor passes.

The tractor to be used for carrying the apparatus can be a larger tractor with front forks or a skid steer tractor which typically has forks mounted on a frame at the front. Thus the tractor schematically indicated at T has forwardly projecting forks F for engaging the drag bar apparatus.

The apparatus 70 includes a generally rectangular frame 71 having a generally planar body for resting on the ground. The frame includes a front transverse member 72 defined by a tubular beam and a rear transverse member 73 defined by a further tubular beam. the beams are held spaced and parallel by end connecting frame tubes 74, 75 and by intervening fork ports or receptacles 76 and 77. The beams 72 and 73 are typically a few feet apart such as of the order of 4 feet. The frame has a width of the order of 8 to 9 feet so that the fork ports are spaced approximately ⅓ and ⅔ along the length acting to divide the frame into approximately three equal sections of the order of 30 to 36 inches in length.

Figure 9:
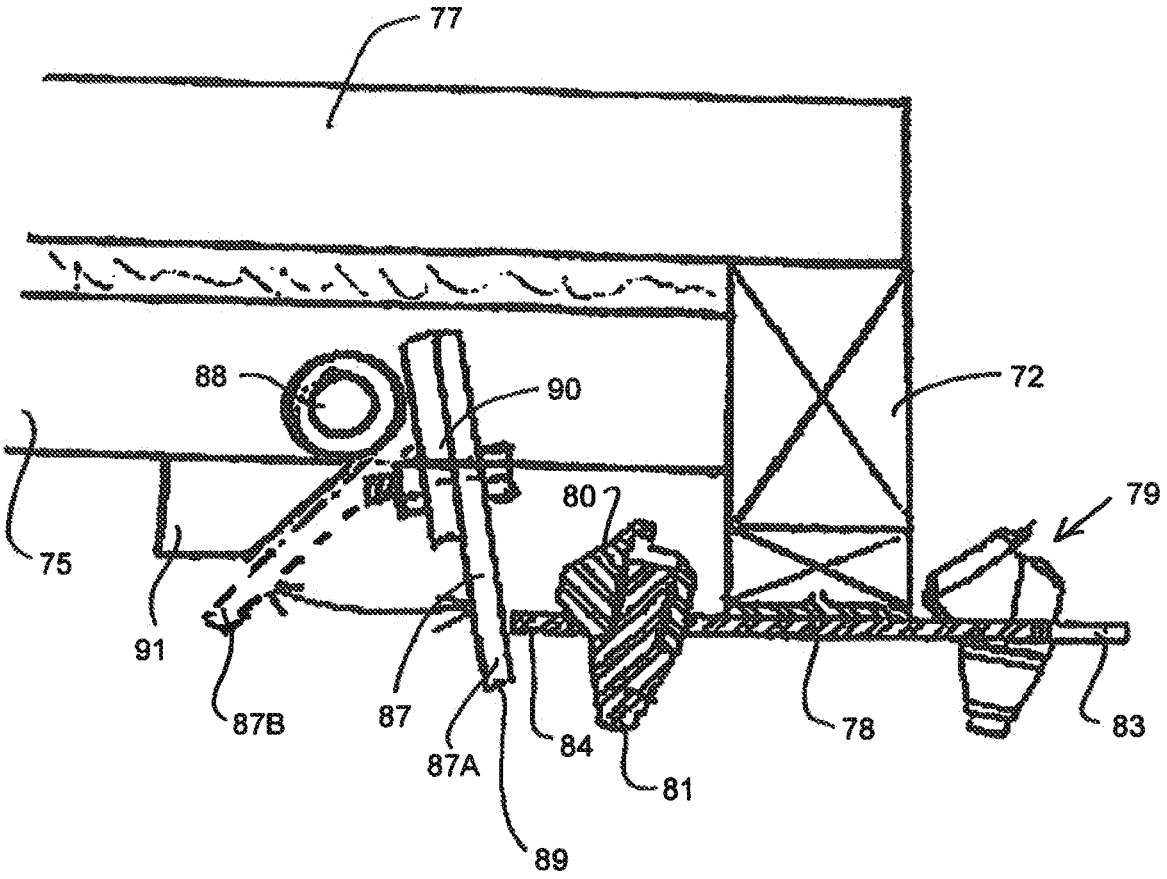
FIG. 9 is an end elevational view along the lines 9-9 of FIG. 8 showing the drag plate mounted on the front transverse member, the drag plate being omitted from FIG. 8 for convenience of illustration.

The frame includes the two fork ports 76, 77 arranged side by side parallel to the forward direction so that the frame can be lifted and moved by the forks of the tractor in the required levelling action. The frame thus forms a welded rigid structure defining the two transverse members 72 and 73 for operating on the ground as explained hereinafter. The frame thus includes the front transverse member 72 and the rear transverse member 73 forming two parallel components for engaging the ground sequentially as the frame is moved forwardly and rearwardly over the ground. As the frame can be moved bi-directionally, the terms front and rear are merely used for convenience of explanation and typically the frame is symmetrical so that it can be picked up at the front or rear by a tractor;

One of the transverse members 72 shown as the front member includes a flat plate 78 welded across an underside of the beam forming the member so as to project forwardly and rearwardly of the beam and so as to sit on the ground as the beam moves across the ground. As best shown in FIG. 9, the plate has carbide pins 79 mounted through the plate by conventional screw fasteners 80 to define a bottom pointed tip 81 projecting downwardly from the bottom of the plate ro define downward projecting ground scraping elements for breaking the surface of the ground. The plate 78 has front edges 83 and rear 84 edges extending across the full width of the frame which are formed as a wave shape with apexes and recesses of the same pitch so that the recess of one is aligned with the apex of the other. Thus when the pins are mounted in the apexes, the pins of the front edge are offset alternately across the width to form two rows of offset pins which operate on the ground alternately. The pins thus cause a scraping action to disturb the upper layer of material to a depth to break up and move an upper layer of a depth of the order of 1 to 2 inches.

The other of the transverse members 73 has a larger plate 85 defining a leveling surface 86 for compressing and levelling the ground surface. The bottom levelling surface is typically curved at the front and rear edges to allow smooth passage over the material to provide an effective levelling action.

As best shown in FIG. 9, the transverse member 72 carries a drag plate 87 therealong stands generally upwardly and is pivotal on a top mounting hinge 88 so as to be movable between front and rear positions 87A and 87B. A lower horizontal edge 89 of the drag plate is located at a height above the lowermost tip 81 of the projecting pins 79 so that the drag plate acts to carry material scarified by the pins.

The drag plate is formed by a flat bar of metal mounted in the hinge 88 by a plate and screw couplings indicated generally at 90. The drag plate is thus pivotal about an axis along the transverse member 72 so as to be pivotal from the first position inclined forwardly and downwardly where it engages the rear of the plate 78 to the second position inclined rearwardly and downwardly in which it engages a stop 91. In the forward position which it takes up as the apparatus moves in the rearward direction, the plate engages the rear edge but openings are defined between the rear edge and the bottom edge caused by the wave form shape of the rear edge. This allows material moving under the plate 87 to pass through the openings to move over the plate 78 to be redeposited on the ground.

Figure 10:
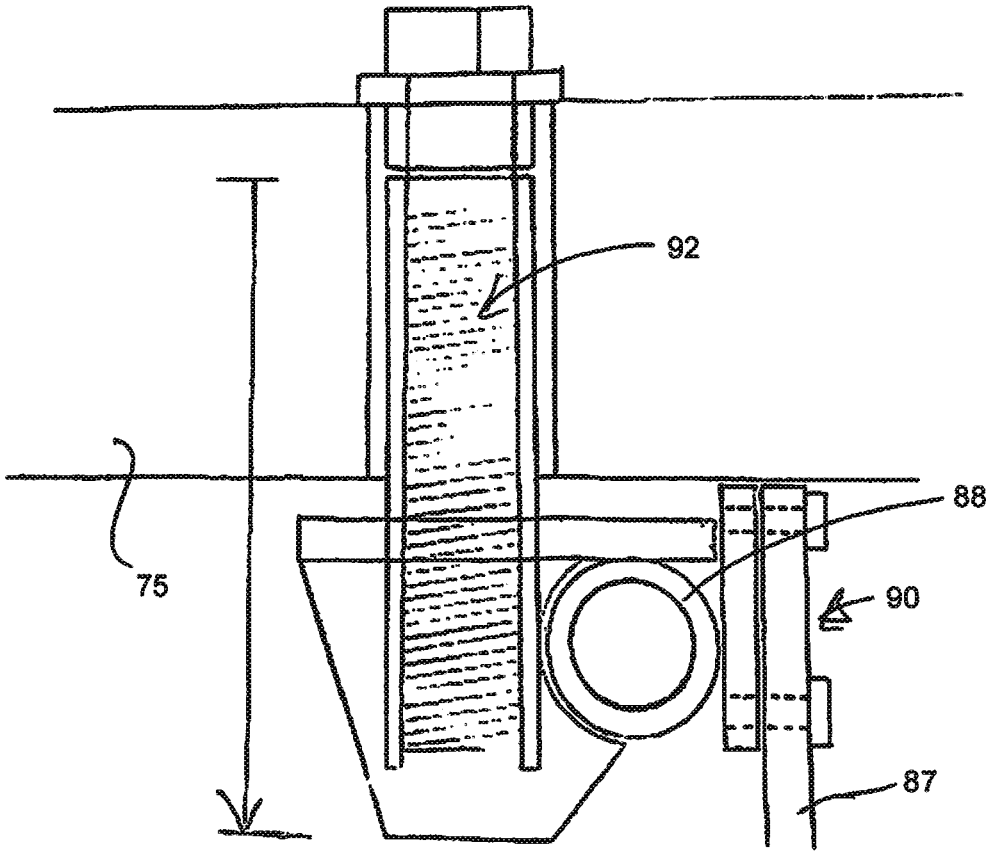
FIG. 10 is an end elevational view showing further details including a height adjustment arrangement for the drag plate mounted on the front transverse member.

As shown in FIG. 10, the hinge 88 is mounted on a screw adjustment 92 carried on the beam 75 so as to adjust a height of the drag plate to accommodate wear of the components and to adjust the operation of the drag plate and teeth.

Figure 8:
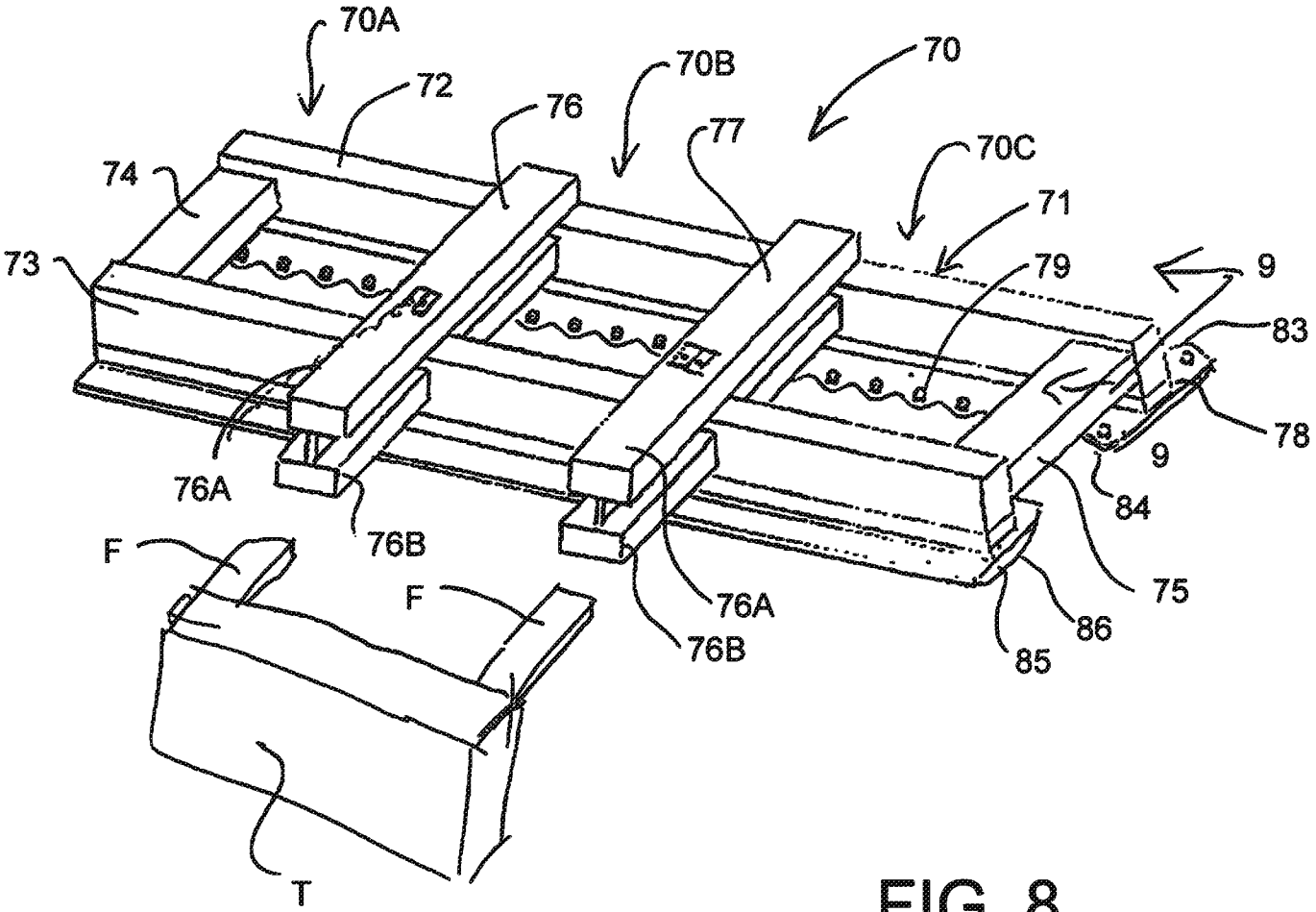
FIG. 8 is an isometric view of a further embodiment of the frame for mounting on forks of a tractor similar to that of FIG. 7.

As shown in FIG. 8, each of the fork ports 76, 77 includes an upper tubular receptacle 76A for receiving a fork of a larger tractor and a lower receptacle 76B for receiving a fork of a skid steer loader. In the figure the receptacles are shown as parallel but it is preferred that (in an arrangement not shown) the lower receptacle 76B is inclined upwardly and forwardly relative to the upper receptacle so that it connects to the receptacle 76A at a position in advance of the forward end. Thus the lower receptacle 76B passes through the transverse member 73 and extends to the upper receptacle at the member 72 with the receptacle 76A being located on top of the transverse members 72 and 73.

Figure 11:
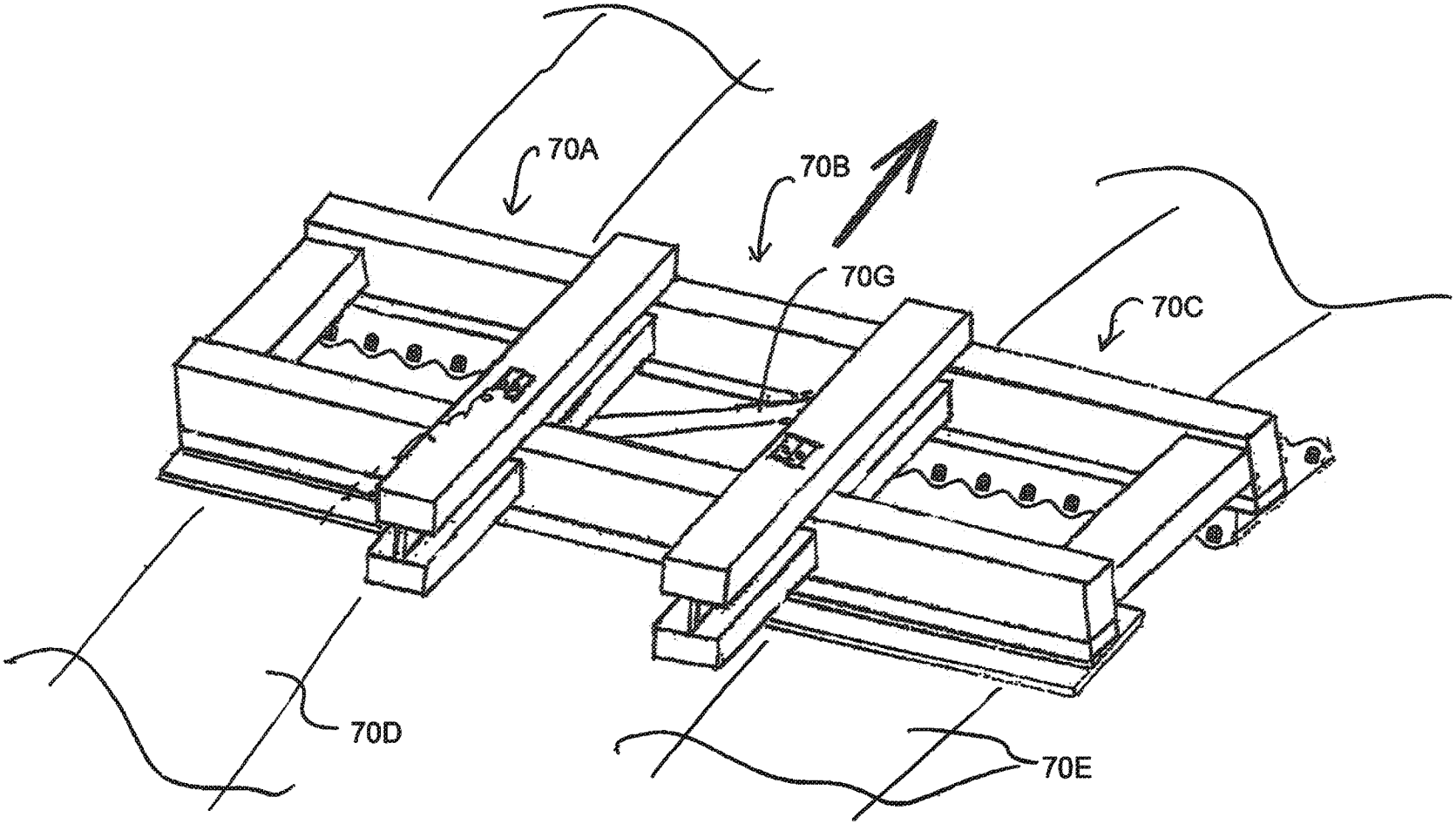
FIG. 11 is an isometric view of the further embodiment of FIG. 8 showing the use of the system for grading gravel roads having tire tracks.

As shown in comparison of FIGS. 8 and 11, the frame is divided into a plurality of sections arranged in a row across the transverse members. In FIG. 8, the teeth and the levelling blade extend across the full width of the frame for operating on a wide band of the ground. Typically the width can be of the order of 9 feet but this can be increased by an increased length of the transverse members of by adding flexing wings. In FIG. 11, at least one of the sections is free from the ground scraping elements and the levelling surface.

In the section 70B where there are is no pins, the free section or sections can include a ground engaging grader bar 70G inclined to a line along the transverse member to draw material from the free section into one of the other sections.

This arrangement can be provided (not shown) for use with gravel roads having two or more traffic parallel spaced wheel strips wherein the toothed section is located between two free wing section with the middle section arranged to grade the material in one wheel track and with at least one of the two wing sections used to carry the material to the track being graded.

Alternatively this arrangement can be provided for use with gravel roads having two or more traffic wheel strips where the free section is a middle section 70B with two wing sections 70A and 70B one on each side for wing sections to be used to grade two traffic wheel strip of the gravel road with the center section arranged to pull material into the wing sections.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A drag bar apparatus for attachment to a tractor allowing levelling a surface of ground over which the tractor passes, the tractor having forwardly projecting forks for engaging the drag bar apparatus, the apparatus comprising:

a frame having a generally planar body for resting on the ground;

wherein the frame includes a mounting coupling for attachment to a front support of the tractor for movement in a forward and rearward direction by the tractor in a levelling action;

the frame including a front transverse member and a rear transverse member forming two parallel components for engaging the ground sequentially as the frame is moved forwardly and rearwardly over the ground;

the front transverse member comprising a plate having downward projecting ground scraping elements for breaking the surface of the ground;

the rear transverse member having a leveling surface for compressing and levelling the surface of the ground;

wherein the plate carries front and rear rows of said ground scraping elements;

and wherein the front and rear rows of the ground scraping elements are arranged with the ground scraping elements of the front row alternately offset from the ground scraping elements of the rear row.

2. The apparatus according to claim 1 wherein the levelling surface includes a vibration mechanism for causing vibration of the levelling surface as it moves across the ground with the frame.

3. The apparatus according to claim 1 wherein said scraping elements comprise carbide pins which extend through the plate to provide a pointed lower end for engaging the ground.

4. The apparatus according to claim 1 wherein said front transverse member carries a drag plate therealong with a lower edge of the drag plate at a height above a lowermost tip of the ground scraping elements.

5. The apparatus according to claim 4 wherein the drag plate is pivotal about an axis along said front transverse member so as to be pivotal from a first position inclined forwardly and downwardly to a second position inclined rearwardly and downwardly.

6. The apparatus according to claim 5 wherein in the first position the drag plate engages a rear edge of the plate.

7. The apparatus according to claim 4 wherein a height of the drag plate is adjustable.

8. The apparatus according to claim 1 wherein the mounting coupling for attachment to a front support of the tractor comprises a first coupling component for attachment to a skid steer loader and additional fork ports for receiving at least one fork of a second separate tractor.

9. The apparatus according to claim 1 wherein the frame is divided into a plurality of sections arranged in a row across the front and rear transverse members where at least one free section of the plurality of sections is free from the ground scraping elements and the levelling surface.

10. The apparatus according to claim 9 wherein said at least one free section includes a ground engaging grader bar inclined to a line along the forward and rearward direction to draw material from the free section into at least one other of the plurality of sections.

11. The apparatus according to claim 9 for use with gravel roads having traffic wheel strips wherein said at least one free section comprises two wing sections each on a respective side of a middle section to be used to grade a single traffic wheel strip of the gravel road with the two wing sections arranged to pull material into the middle section.

12. The apparatus according to claim 9 for use with gravel roads having two traffic parallel spaced wheel strips wherein said at least one free section is located between two wing section with the two wing sections to be used to grade the two traffic wheel strips of the gravel road with the middle section arranged to pull material into at least one of the two wing sections.

13. A drag bar apparatus for attachment to a tractor allowing levelling a surface of ground over which the tractor passes, the tractor having forwardly projecting forks for engaging the drag bar apparatus, the apparatus comprising:

a frame having a generally planar body for resting on the ground;

wherein the frame includes a mounting coupling for attachment to a front support of the tractor for movement in a forward and rearward direction by the tractor in a levelling action;

the frame including a front transverse member and a rear transverse member forming two parallel components for engaging the ground sequentially as the frame is moved forwardly and rearwardly over the ground;

the front transverse member comprising a plate having downward projecting ground scraping elements for breaking the surface of the ground;

the rear transverse member having a leveling surface for compressing and levelling the surface of the ground;

wherein the plate has front and rear edges each of which is shaped in a plane of the plate to define a wave pattern;

and wherein the plate carries front and rear rows of said ground scraping element and wherein the wave patterns are out of phase so that the ground scraping elements are arranged with the ground scraping elements of the front row alternately offset from the ground scraping elements of the rear row.

14. A drag bar apparatus for attachment to a tractor allowing levelling a surface of ground over which the tractor passes for use with gravel roads having traffic wheel strips, the tractor having forwardly projecting forks for engaging the drag bar apparatus, the apparatus comprising:

a frame having a generally planar body for resting on the ground;

wherein the frame includes a mounting coupling for attachment to a front support of the tractor for movement by the tractor in a levelling action;

the frame including a first transverse member having downward projecting ground scraping elements for breaking the surface of the ground;

the frame including a second transverse member having a leveling surface for compressing and levelling the surface of the ground;

wherein the frame is divided into a plurality of sections arranged in a row across the front and rear transverse members where at least one free section of the plurality of sections is free from the ground scraping elements and the levelling surface;

wherein said at least one free section comprises two wing sections each on a respective side of a middle section to be used to grade a single traffic wheel strip of the gravel road with the two wing sections arranged to pull material into the middle section.

15. A drag bar apparatus for attachment to a tractor allowing levelling a surface of ground over which the tractor passes for use with gravel roads having two traffic parallel spaced wheel strips, the tractor having forwardly projecting forks for engaging the drag bar apparatus, the apparatus comprising:

a frame having a generally planar body for resting on the ground;

wherein the frame includes a mounting coupling for attachment to a front support of the tractor for movement by the tractor in a levelling action;

the frame including a first transverse member having downward projecting ground scraping elements for breaking the surface of the ground;

the frame including a second transverse member having a leveling surface for compressing and levelling the surface of the ground;

wherein the frame is divided into a plurality of sections arranged in a row across the front and rear transverse members where at least one free section of the plurality of sections is free from the ground scraping elements and the levelling surface;

wherein said at least one free section is located between two wing sections with the two wing sections used to grade the two traffic wheel strips of the gravel road with the middle section arranged to pull material into at least one of the two wing sections.

* * * * *